US005086990A

United States Patent [19]

Wetter

[11] Patent Number: 5,086,990

[45] Date of Patent: Feb. 11, 1992

[54] ROVING GUIDE

[75] Inventor: Kurt Wetter, Hagenbuch, Switzerland

[73] Assignee: Rieter Machine Works, Ltd., Winterthur, Switzerland

[21] Appl. No.: 615,385

[22] Filed: Nov. 19, 1990

[30] Foreign Application Priority Data

Nov. 20, 1989 [CH] Switzerland ..... 4158/89

[51] Int. Cl.[5] ..... B65H 57/02; B65H 57/16; B65H 57/26

[52] U.S. Cl. ..... 242/157 R; 57/352; 242/131

[58] Field of Search ..... 242/157 R, 157 C, 131, 242/131.1, 42, 47.01, 47.08, 47.09, 47.12, 130.2, 130, 129.5; 19/243; 57/352, 281

[56] References Cited

U.S. PATENT DOCUMENTS

| | | | |
|---|---|---|---|
| 721,828 | 3/1903 | O'Neil | 242/157 R |
| 2,266,364 | 12/1941 | Hardie | 242/157 R |
| 2,440,151 | 4/1948 | Nelson | 242/157 R X |
| 4,408,731 | 10/1983 | Schenkel | 242/157 R X |

FOREIGN PATENT DOCUMENTS

| | | | |
|---|---|---|---|
| 544123 | 2/1932 | Fed. Rep. of Germany | 242/157 R |

*Primary Examiner*—Stanley N. Gilreath
*Attorney, Agent, or Firm*—Kenyon & Kenyon

[57] ABSTRACT

A retaining rod of a roving guide is engaged in a carrier beam and secured by a resilient support member which also prevents any transmission of vibrations. The roving guide has a deflector for rovings each associated with a groove. The grooves are offset from the vertical centerplane of the machine.

8 Claims, 1 Drawing Sheet

FIG. 1.
(Prior Art)
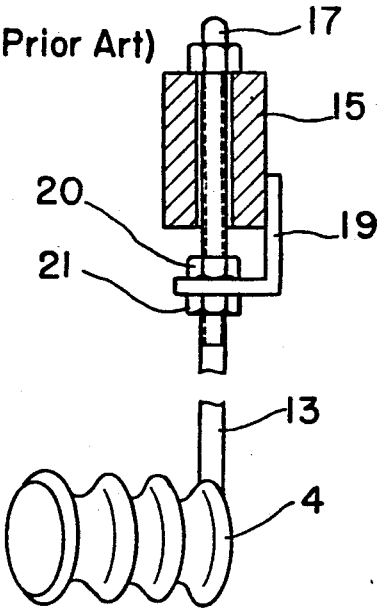
FIG. 3.
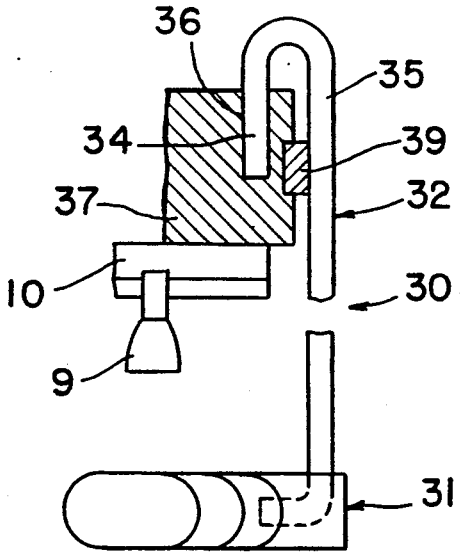
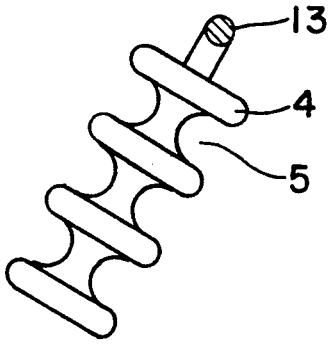
FIG. 2.
(Prior Art)
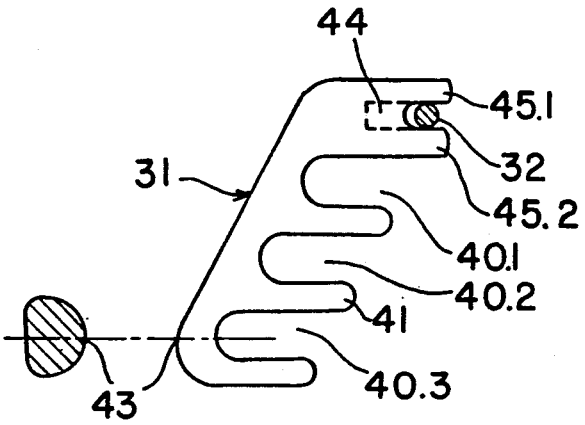
FIG. 4.
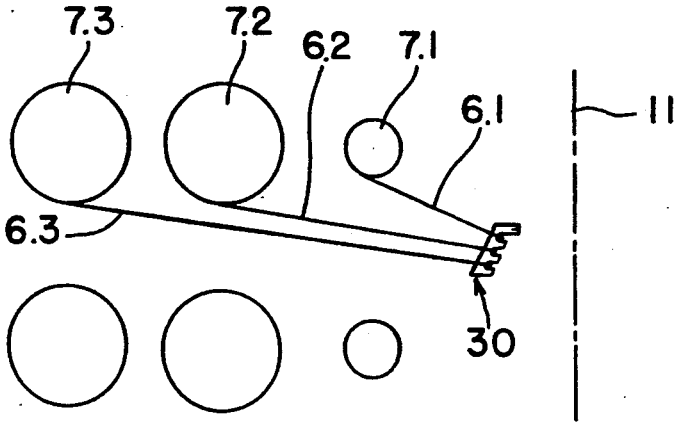
FIG. 5.

ROVING GUIDE

This invention relates to a roving guide.

As is known, various types of roving guides have been used in textile machines, for example, in ring spinning machines for the guidance of rovings from bobbins to the spinning stations. For example, U.S. Pat. No. 4,408,731 describes a roving guide for a ring spinning machine which includes a deflector for a limited number of rovings and a retaining rod connected to the deflector and carried on a carrier beam of a creel of a textile machine. However, such a roving guide has a number of disadvantages with respect to assembly, maintenance of the setting of the deflector, production costs, vibrations and so on.

Accordingly, it is an object of the invention to provide an improved roving guide which can be assembled rapidly, simply, reliably and in a manner to be free of vibrations.

It is another object of the invention to provide a roving guide for a textile machine which can be produced economically and which has a reduced number of parts.

It is another object of the invention to provide a roving guide of relatively simple construction which can be readily mounted and dis-mounted in place.

Briefly, the invention provides a roving guide including a comb-like deflector having a plurality of grooves for deflecting a plurality of rovings and a retaining rod having one arm secured to and extending from the deflector and a second free arm extending from the first arm for mounting on a carrier beam.

In accordance with the invention, the roving guide is to be mounted on a carrier beam which extends in parallel to a predetermined plane such as the center plane of a textile machine as well as a resilient member between and in contact with the carrier beam and one arm of the roving guide. The construction of the roving guide is such that the free arm can be mounted in a groove in the carrier beam in a slidable manner, for example, by being dropped vertically into the groove of the carrier beam.

These and other objects and advantages of the invention will become more apparent from the following detailed description taken in conjunction with the accompany drawings wherein:

FIG. 1 illustrates a part sectional view of a known roving guide;

FIG. 2 illustrates a plan view of the deflector of the roving guide of FIG. 1;

FIG. 3 illustrates a part sectional view of a roving guide constructed in accordance with the invention on a carrier beam;

FIG. 4 illustrates a plan view of the deflector of the roving guide of FIG. 3 in accordance with the invention; and FIG. 5 illustrates a schematic view of a deflector of a roving guide in accordance with the invention positioned between a plurality of bobbins and a center plane of a textile machine.

Referring to FIGS. 1 and 2, the roving guide of known construction has a deflector 4 in the form of a body of rotation formed with three annular grooves 5 for receiving rovings which may be paid off from respective roving bobbins (not shown). As indicated, the deflector 4 is mounted by way of a retaining rod 13 on a carrier beam 15. This retaining rod 13 extends vertically upwardly through a bore in the carrier beam 15 and is held in place by a cap nut 17 which is threaded onto a threaded upper end of the rod 13. As such, the cap nut 17 supports the entire weight of the roving guide. In addition, an angle plate 19 is clamped between two nuts 20, 21 on the rod 13 at a point spaced below the carrier beam 15. This angle plate 19 engages by way of a vertical arm with a longitudinal surface of the beam 15 in order to adjust the inclination of the deflector 4. The purpose of the separation between the beam 15 and the nut 20 is to reduce the transmission of vibrations of the frame and, therefore of the beam 15, to the rod 13 and deflector 14. As such, the conventional roving guide is embodied by a number of parts 17–21 and so on, something which is unsatisfactory production-wise. Also, the top part of the rod 13 must be formed with a screw thread. Assembly is particularly complex since the angle plate 19 can be moved into the required position only after some trial and error. There is also the risk of vibrations loosening the clamping of the angle plate 19.

Referring to FIGS. 3 and 4, the roving guide 30 includes a comb-like deflector 31 and a retaining rod 32.

The comb-like deflector 31 has a plurality of grooves 40.1, 40.2, 40.3 separated by webs 41. These grooves are sized so as to receive rovings with the grooves disposed in staggered relation to a center plane 11 (see FIG. 5) of the textile machine.

As indicated in FIG. 5, the deflector 30 receives rovings 6.1, 6.2, 6.3 from a plurality of bobbins 7.1, 7.2, 7.3. The bobbins 7.1, 7.2, 7.3, are disposed by way of a holder pin 9 (see FIG. 3) on a cross-rail 10 in a creel of a ring spinning machine so as to be movable towards the vertical center plane 11 of the machine. Two bobbins 7.1, 7.2 are operating bobbins while the third bobbin 7.3 is a reserve bobbin. The rovings 6.1, 6.2 pass by way of the grooves 40.1, 40.2 to two adjacent drafting units (not shown).

After the bobbin 7.1 has emptied, the roving 6.2 is changed over manually or automatically into the groove 40.1 which has become empty due to the roving 6.1 becoming exhausted and the roving 6.3 is similarly changed over into the groove 40.2 made vacant by the changeover of the roving 6.2. The bobbins 7.1, 7.2, 7.3 are moved towards the center plane 11 so that a fresh reserve bobbin can be placed on the cross rail 10.

Referring to FIG. 3, the angled position of the deflector 31 is such as to ensure that the rovings pass by one another on the skew and do not contact one another. German Patent Application P3926347.9 published Feb. 14, 1991 describes such a structure in more detail.

Referring to FIG. 3, the retaining rod 32 has one arm 35 extending upwardly from the deflector 31, for example, vertically, and a second free arm 34 extending from the arm 35 via a bend into an aperture or elongated groove 36 in a carrier beam 37. As indicated, the two arms 34, 35 are in parallel relation to each other. The free arm 34 simply hangs or is slidably mounted in the groove 36 of the carrier beam which, in turn, extends parallel to the center plane (not shown) of the creel of the spinning machine. This carrier beams 37, in turn, supports the cross rails 10, only one of which is shown.

In addition, a resilient member 39 in the form of an elongated strip of resilient rubber of plastics is mounted within a corresponding elongated groove in the beam 37. This support member 39 can be inserted into the beam 37 during fabrication of the carrier beam 37.

The aperture or groove 36 in the carrier beam 37 and the free arm 34 of the retaining rod 32 can be associated with one another with a clearance. The final assembly comprises merely engaging the free arm 34 in the groove 36 so that the rod 32 is positioned finally, reliably and in a non-movable manner.

The support member 39 is effective to position the rod 32 in a non-movable manner and to inhibit the transmission of vibrations.

Although the arms 34, 35 can diverge from one another, the arms preferably extend parallel to one another. Advantageously, the rod 32 extends vertically and the deflector 31 of the roving guide 30 extends horizontally.

Referring to FIG. 4, the deflector 31 which is preferably made of plastic is mounted on a bent end zone 44 of the rod 32 which extends from the arm 35 of the rod 32 which may be made of metal. This bent end 44 may be held or pressed or glued into the deflector 31. As indicated, part of the vertical rod 32 extends between two webs 45.1, 45.2 of the deflector 31. The engagement of the bent end part 44 of the rod 32 ensures that the deflector 31 is located relative to the rod 32 without vibrations.

As indicated in FIGS. 4 and 5, the grooves of the deflector 31 are positioned in staggered relation to the center plane 11 such that a base 43 of each groove is spaced differently from the center plane 11. That is, the base of the groove 40.1 adjacent the rod 32 is closer to the center plane 11 of the machine than the base 43 of the groove 40.3 farthest from the plane 11.

The invention thus provides a roving guide 30 which has few parts and which can be assembled in a relatively fast manner, particularly with respect to a roving guide as shown in FIGS. 1 and 2.

The invention further provides a roving guide which can be readily assembled on a carrier beam for a creel of a spinning machine.

Still further, the invention provides a roving guide which can be assembled in a manner in which a deflector is prevented from inadvertent turning from a mounted position.

What is claimed is:

1. In a textile machine, the combination of a carrier beam extending in parallel to a predetermined plane;

a roving guide mounted on said beam for guiding a plurality of rovings relative to said plane, said guide including a deflector for deflecting a plurality of rovings thereabout and a retaining rod secured at one end to said deflector, said rod having one arm extending from said deflector and a free arm extending from said one arm into said beam; and a resilient member between and in contact with said beam and said one arm of said guide.

2. The combination as set forth in claim 1 wherein said arms of said retaining rod are in parallel to each other.

3. The combination as set forth in claim 1 wherein said retaining rod is vertically disposed.

4. The combination as set forth in claim 1 wherein said resilient member is mounted on said beam.

5. The combination as set forth in claim 1 wherein said retaining rod has a bent end zone extending from said one arm and secured in said deflector.

6. The combination as set forth in claim 1 wherein said deflector has a plurality of grooves for receiving rovings respectively therein, said grooves being disposed in staggered relation to said plane.

7. The combination as set forth in claim 1 wherein said deflector is of comb-shape with a plurality of grooves, said groove adjacent said rod being closer to said plane than a groove furthest from said plane.

8. The combination as set forth in claim 1 wherein said deflector is made of plastic.

* * * * *